United States Patent [19]

Lee et al.

[11] Patent Number: 5,055,078

[45] Date of Patent: Oct. 8, 1991

[54] MANUFACTURING METHOD OF OXIDE CATHODE

[75] Inventors: Anseob Lee; Kyungcheon Son, both of Suwon, Rep. of Korea

[73] Assignee: Samsung Electron Devices Co., Ltd., Rep. of Korea

[21] Appl. No.: 452,515

[22] Filed: Dec. 18, 1989

[51] Int. Cl.[5] ..... H01J 9/04

[52] U.S. Cl. ..... 445/51; 427/77

[58] Field of Search ..... 445/50, 51; 427/77; 313/346 DC

[56] References Cited

U.S. PATENT DOCUMENTS 4,675,570 6/1987 Green ..... 445/51 X 4,957,463 9/1990 Branovich et al. ..... 445/51 X

*Primary Examiner*—Kenneth J. Ramsey

[57] ABSTRACT

A manufacturing method of oxide cathode for electron tube in which adding method of scandium Sc and yttrium Y for extending duration of ternary carbonate solid solution is improved and excellent effects is obtained so that duration and electron emitting characteristics are improved. The invention is carried out by obtaining quinary (Ba, Sr, Ca, Sc, Y) carbonate and painting this on cap whereby manufacturing electron emitting substance layer. According to the invention, extension of duration and improvement of electron emitting characteristic can be obtained.

2 Claims, 1 Drawing Sheet

MANUFACTURING METHOD OF OXIDE CATHODE

BACKGROUND OF THE INVENTION

The present invention relates to a manufacturing method of oxide cathode for electron tube, and particularly, to a manufacturing method of oxide cathode for electron tube in which adding manner of scandium Sc or yttrium Y for extending the duration of ternary carbonate solid solution is improved and more excellent diffusing effects is obtained and thereby electron emitting characteristic is improved.

According to the prior art, heat treated scandium or yttrium is added to ternary carbonate solid solution in oxide state at predetermined rate, and this is made to mixed solution with pertinent adhesive agent (mainly nitro cellulose) and organic solvent (isoamyl acetate, alcohol etc.), and then this is ball milled and slurry is made, and this slurry is painted on the basic body metal (cap) by means of spraying or electric adhering, and thus a cathode is formed by melting said cap on a sleeve thereof. Electronic gun used said cathode is assembled and capped on tube, and process such as themo-dissolution and activation are passed through, whereby said slurry is used for the electron emitting material, at this moment, scandium or yttrium can be added to the slurry after ball milling of it, and it can also be used with other form (hydroxide nitrate etc.) other than oxide.

However, in case when scandium or yttrium is added by conventional method, since these scandium or yttrium is made to mix with ternary carbonate powder in powder state, mixture of uniform condition is hard to obtain, particularly in case when slurry is made by ball mill and then powder of scandium or yttrium is added to this, since there is worry that ternary carbonate crystal is broken, not only it is difficult to use ball milling method capable of obtaining sufficient diffusing effect, but since scandium or yttrium is added with small quantity, when sufficient diffusion is not obtained, there is disadvantage that it is hard to expect the improving effect of previously described duration characteristic and electron emitting characteristic.

SUMMARY OF THE INVENTION

The present invention is invented to solve such disadvantage as above description, in order to obtain the sufficient diffusion effect, which is organized such that nitrate of scandium Sc and yttrium Y, and ternary carbonate (Ba, Sr, Ca) are simultaneously mixed whereby being made to aqueous solution of nitrate, and carbonate precipitating agent is added to this and quinary carbonate is obtained, and this mixed well with adhesive material and ball milled and slurry is made, and then it is painted on the basic body metal (cap) by means of spraying or electric adhering, so that further more excellent diffusion effect than mixture of powder state can be obtained.

The forgoing and other objects as well as advantages of the present invention will become clear by following description of the invention with reference to the accompanying drawings.

BRIEF DESCRIPTION OF THE INVENTION

For a better understanding of the invention, and to show how the same may be carried out into effect, reference will now be made, by way of example, with respect to the accompanying drawing, in which:

The sole FIGURE is a longitudinal cross sectional view showing general oxide cathode structure, in which the numeral symbol:

1 represents oxide covering layer,
2 represents basic body metal,
3 represents sleeve,
4 represents heater.

DETAILED DESCRIPTION OF THE INVENTION

Figure 1:
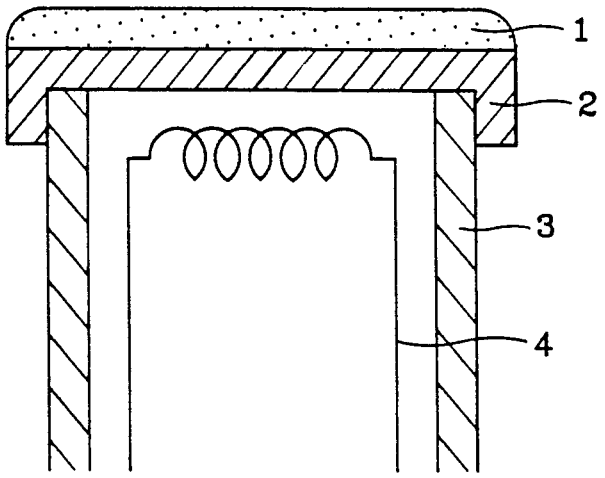

Hereinafter, the present invention will be described in detail with reference to the accompanying drawing.

A manufacturing method of ternary carbonate slurry for oxide cathode which is not added with scandium or yttrium is as followings.

(i) To aqueous solution of nitrate of a predetermined composition of Ba, Sr, Ca, (ii) precipitating agent of $NaCO_3$ or $(NH_4)_2\ CO_3$ is added to said aqueous solution and ternary carbonate solid solution with $O_3$ is made, and then (iii) this is cleaned, filtered and dried and then ternary carbonate solid solution powder is obtained.

(iv) Ternary carbonate solid solution powder and appropriate adhesive material as well as organic solvent are mixed at predetermined rate, (v) this mixture is diffused by means of ball milling and the like whereby carbonate slurry is obtained, and (vi) this slurry is painted on the basic body metal (cap) by means of spraying and the like.

The cap which being of part of electron gun is substantially completed through the process of (i) to (vi).

Conventional method of the case for adding the powder of compound of scandium Sc and yttrium Y is known to use a method in which either scandium Sc and yttrium Y compound powders are mixed at a predetermined rate of process (iv) and then post-processes of (v) and (vi) are executed, or said powder is added to carbonate slurry at a predetermined rate at between the processes of (v) and (vi) and mixed by means of ball milling and the like and then post-process of (vi) is carried out.

Since aforementioned conventional adding method of scandium Sc and yttrium Y is the mixing of powder state, it is considered that either sufficient uniform diffusion effect is hard to expect because of difference of specific gravity and cohesion among materials, or sufficient uniform diffusion effect can not be obtained until long period of time is elapsed.

In order to improve these, according to the present invention, instead of the powder of compound of scandium Sc and yttrium Y, as in the process (i) of previously mentioned manufacturing method, scandium Sc and yttrium Y are added to nitrate of Ba, Ca, Sr and aqueous solution of nitrate of predetermined composition is made, and it is passed through the process of (ii) to (vi).

Wherein quinary carbonate solid solution powder is obtained instead of ternary carbonate solid solution powder at the process (iv), so that difficulty of diffusing characteristic appearing in addition of compound powder (Sc and Y) is eliminated.

Since the particle form of quinary carbonate added with small quantity of scandium Sc and yttrium Y has a particle form of needle shape appeared in ternary carbonate and it is a carbonate state as ternary carbonate, being thermodissoluted in the time of K-decomposition in exhausting process and becoming to oxide, and produced carbonic acid gas is exhausted into the interior of tube, and therefore, there is no influence of affecting to environment of interior of tube.

Since the carbonate solid solution produced by the present invention is obtained with quinary carbonate added with two substances (Sc and Y) different from existing ternary carbonate, aunevenly diffusing characteristic appeared in powder mixing is eliminated, and therefore, there is advantage that improvement of duration and electron emitting characteristic according to this can be expected.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. In manufacturing oxide cathode for an electron tube, a method of manufacturing oxide cathode the steps comprising: obtaining quinary (Ba, Sr, Ca, Sc, Y) carbonate solid solution for improving a duration and an electron emitting characteristic of carbonate solid solution, and painting said quinary carbonate solid solution on a cap of a cathode, so that an electron emitting substance layer is manufactured.

2. Manufacturing method of oxide cathode according to claim 1 wherein said carbonate solid solution is quinary (Ba, Sr, Ca, Sc, Y) carbonate particularly contained with scandium and yttrium to ternary carbonate (Ba, Sr, Ca).

* * * * *